US007611014B2

(12) United States Patent
Portella Bobé et al.

(10) Patent No.: US 7,611,014 B2
(45) Date of Patent: Nov. 3, 2009

(54) PACKAGE FOR CIGARETTE ROLLING PAPER

(75) Inventors: Carlos Portella Bobé, Barcelona (ES); Antoni Albareda Soteras, Barcelona (ES)

(73) Assignee: Miquel y Costas & Miquel S.A., Barcelona (ES)

( * ) Notice: Subject to any disclaimer, the term of this patent is extended or adjusted under 35 U.S.C. 154(b) by 362 days.

(21) Appl. No.: 11/455,237

(22) Filed: Jun. 19, 2006

(65) Prior Publication Data

US 2007/0221528 A1 Sep. 27, 2007

(30) Foreign Application Priority Data

Mar. 9, 2006 (ES) ..... 200600591

(51) Int. Cl.
*B65D 73/00* (2006.01)

(52) U.S. Cl. ..... 206/494; 206/256; 206/449; 206/233

(58) Field of Classification Search ..... 206/494, 206/256, 449, 817, 233, 255
See application file for complete search history.

(56) References Cited

U.S. PATENT DOCUMENTS 2,501,357 A * 3/1950 Speckman et al. ..... 221/58
2,636,599 A * 4/1953 Willis et al. ..... 221/48
3,459,329 A * 8/1969 Mochizuki et al. ..... 221/34
5,158,205 A * 10/1992 Bodziak et al. ..... 221/51
5,540,354 A * 7/1996 Annand ..... 221/52
5,901,875 A * 5/1999 Flygenring ..... 221/56
5,967,311 A * 10/1999 Ruppert et al. ..... 206/256

FOREIGN PATENT DOCUMENTS

| | | |
|---|---|---|
| EP | 0901971 | 3/1999 |
| FR | 1085585 | 2/1955 |
| FR | 2886105 | 12/2006 |
| WO | WO 95/33667 | 12/1995 |

* cited by examiner

*Primary Examiner*—Mickey Yu
*Assistant Examiner*—Chun Cheung
(74) *Attorney, Agent, or Firm*—Pravel Intellectual Property Law, P.C.; James W. Pravel

(57) ABSTRACT

This package is made up of a sheet (1) that once having been die cut, folded and assembled, makes a prismatic rectangular shaped package that has longitudinal slots (18) for the successive extraction of the sheets of paper to roll cigarettes (21) that are stored in two or more wads of paper (2) housed on the inside of the package and supported on a reinforcing card (3) placed on the inner surface of the lower wall (14) of the package. This reinforcing card (3) has, at least two tabs (31) to retain the wads of paper (2), placed between the wads of paper (2), orientated towards the upper area, respectively inclined towards the front and rear walls of the package, and hinged on both fold lines (32) coinciding with a longitudinal X-X axis, parallel to the wads of paper (2) and the slots (18) for the extraction of the sheets of paper (21).

7 Claims, 3 Drawing Sheets

PACKAGE FOR CIGARETTE ROLLING PAPER

FIELD OF THE INVENTION

The present invention refers to a package for cigarette rolling paper, being of the type aimed at containing two or more wads of paper arranged in a zigzag to be removed sheet by sheet through some slots provisioned in said package.

BACKGROUND OF THE INVENTION

The paper to roll cigarettes is traditionally used so that smokers can roll their own cigarettes from bulk pipe tobacco. These sheets of paper are arranged in a package in which said sheets of paper are folded and piled in a zigzag forming wads, in such a way that the successive sheets of paper can be removed, one by one, simply pulling the piece that is sticking out of a slot or opening.

These packages are made up from a sheet of card or something similar, that is thin, die cut and assembled by fitting and overlapping the protruding edges or gluing, and by a relatively strong cardboard card, as reinforcement in order to give mechanical strength to the assembly, located between the wad of paper and the base wall of the package. These packages generally have a small capacity, approximately 50 sheets of paper in each wad, hence they run out quickly. The packages with larger capacity wads of paper, more than 100 sheets, have problems because as the paper is used the wad can move around on the inside of the package, with the disadvantage that the portion of paper that protrudes through the slot can become hidden on the inside, making its difficult to grip and extract.

There are also packets and wrappings that contain two or more wads of paper. These packages are made up of the same type of thin sheet, die cut and assembled by fitting and overlapping the protruding edges or gluing, making a prismatic rectangular package closed on all sides, fitted with slots for the removal of the sheets of paper making up the wad, and a cover to enclose the surface of the stated slots.

The sheet of thin card has a lower wall that is noticeably rectangular, making the base of the package, that is extended laterally in two holding tabs, by its rear end to a rear wall and a closing flap, and by its front end to a front wall and a rectangular upper wall, that has at least two longitudinal slots through which the sheets of paper are extracted from the wads. This upper wall is extended at its rear end to a rear wall and closure flap, fitted between the flaps of the lower wall and said lower wall and, laterally in some lateral walls that are finished off in some tabs that laterally grip the wads of paper and a reinforcing card located between said wads and the base wall of the package. The disadvantage of this type of packaging is that the wads of paper move around on the inside of the packaging, especially if some of the sheets of paper have already been used from said wads, and the part of the paper that protrudes through the slot or opening disappears inside the cavity, making the removal of the next sheet of paper significantly more difficult.

The European patent EP901971 of EFKA-Werke Fritz Kiehn GmbH describes a package for cigarette rolling papers with this general configuration and which has some die cut tabs in the part or upper wall of the thin sheet of card to make a separation between the wads on the inside of the package. These tabs are folded inwards and jointed on both lines of the transversal fold, arranged perpendicularly to the slots, in such a way that said tabs are arranged transversally between the wads of paper.

This solution initially prevents the remaining wad of paper from moving freely when one wad has been used up. However, the poor mechanical features of the short, thin piece of card that makes up each one of the two tabs cause the remaining wad, after the using up of the first, to bend and thus said remaining wad of paper makes inappropriate movements inside of the double cavity and the piece of paper that protrudes through the slot or opening disappears inside of the cavity, and hence once again there is the significant difficulty of extracting the next sheet of paper. This solution also presents another disadvantage from an aesthetic point of view as the openings or die cuts that make the tabs are clearly visible through the paper extraction slots.

SUMMARY OF THE INVENTION

The package for the cigarette rolling papers of this invention has some construction characteristics aimed at allowing the efficient storage of at least two wads of cigarette rolling paper in its interior, preventing them from moving in their location, without the elements or means for the retention of said wads of paper from being able to easily yield, and without said means of retention being visible from the outside of the packaging.

This package is of the type that is made up into a box, shaped by a thin sheet of card or something similar, that is suitably die cut, folded and assembled making a prismatic rectangular package closed on all sides, fitted with slots for the removal of the single successive sheets of cigarette rolling paper; in addition said package having a foldable lid, made up from the same sheet, for the cover of the side fitted with the removal slots. Next to the base wall of the package there is a relatively strong cardboard card acting as reinforcement in order to give mechanical improvement to the assembly. The wads of paper are fitted between this reinforcing card and the front face of the package.

In accordance with the invention, the package has two or more tabs that protrude obliquely towards the upper part of the reinforcing card arranged on the inside of the lower part of the package and which makes the support surface for the wads of cigarette rolling paper.

Said tabs are arranged between the wads of paper and have a fold line in a longitudinal orientation and parallel to the wads and the slots defined in the upper wall of the packaging for the extraction of the sheets.

These tabs are inclined towards the front and rear walls of the packaging, exerting a slight pressure on the corresponding back and front wads, and providing their separation and retention against the inner reinforcing card and, respectively, against the front and rear walls of the package. This retention is produced independently of the number of papers that remain in the wad.

This makes it easier so that, even though few sheets of paper remain in the wad, said papers can be extracted easily as there is no play or possibility of lateral movement.

In accordance with the invention, the tabs are supported on the upper edges facing the wads, ensuring that they are held in place.

These tabs can be made by some die cuts made in the reinforcing card located in the base of the package, hence neither the die cuts nor the tabs are visible from the outside of the package; or are fixed to the reinforcing card by conventional means, for example by gluing, in such a way that they are still not visible from the outside of the package.

Each wad of paper can be in contact with a single tab or with several tabs that give support in a multiple and distributed manner.

In the case of the die cut tabs, the tabs that separate the two adjacent wads of paper in the same package can be die cut in such a way that, even though they all have the tab fold line coinciding on the line that has to correspond with the separation of the two adjacent wads of paper, some have the cut of the die cut closer to the rear wall and others have the die cut closer to the front wall, in such a way that, on folding the tabs towards the upper area of the reinforcing card and due to the tendency of the initial tab fold lines to reduce in order to lessen the tension produced in the areas of said folds, one or several tabs will slope towards the front section with which an improved additional holding effect is achieved for the wad of paper next to the front wall.

In the case in which the tabs are fixed to the reinforcing card, for example, by gluing, the same technique of alternating the orientation of the tab folding can be seen so that once they are fixed to the reinforcing card an improved additional holding effect is suitably made for both adjacent wads of paper.

BRIEF DESCRIPTION OF THE DRAWINGS

In order to complete the description that will be made below and for the purpose of giving a greater understanding of its characteristics, this present descriptive memorandum is accompanied by a set of drawings, which is illustrative but not limiting, where the following can be seen.

PREFERRED EMBODIMENT OF THE INVENTION

Figure 1:
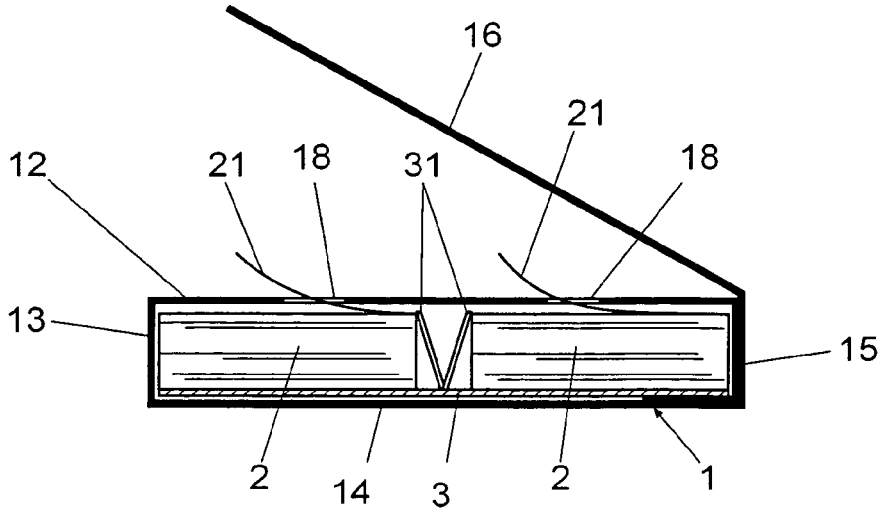
FIG. 1 shows a transversally sectioned view of the cigarette rolling paper package.
Figure 2:
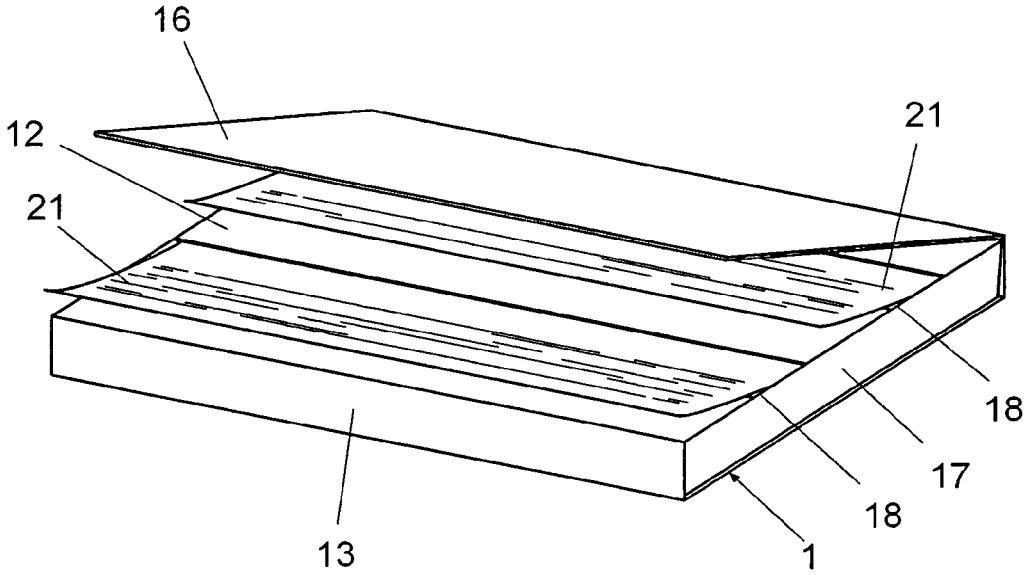
FIG. 2 shows a perspective view of the package.

As can be seen in the referred to figures the cigarette rolling paper package is made up of a die cut sheet (1) of thin card, forming a rectangular prismatic shaped package, closed on all sides, and fitted with some slots (18) for the extraction of the paper to roll cigarettes (21) that are folded and arranged in a zigzag manner on the inside of the package, making up two wads of paper (2).

The sheet (1) has, differentiated by the fold lines, some areas that provide the package with: a rear wall (11), an upper wall (12) into which the slots (18) are arranged longitudinally for the removal of the sheets of paper (21) to roll cigarettes, a front wall (13), a lower wall (14) that extends towards the rear area in a second rear wall (15) and a lid (16), and some side walls (17).

The side walls (17) and the lower wall (14) are extended at their lower end into some wings (17*a*, 14*a*) that are arranged to superimpose on the inner surface of the lower wall (14), jointly making the limits of a space with said lower wall (14) for the introduction of a retaining wing (11*a*) that starts from the lower end of the rear wall and that is used to hold the package in its assembled position.

In said assembly position the second rear wall (15) and the lid (16) remain free and with the possibility of folding over onto the rear wall (11) and the upper wall (12) of the package respectively, in said position covering the slots (18).

On the inside of the package there is a reinforcing card (3) fitted having greater consistency than the sheet (1) and which is used as the support base for the wads of paper (2) used for the rolling of cigarettes (21).

Said reinforcing card (3) is supported on the tabs (11*a*, 14*a*, 17*a*) and on the lower wall (14) of the package.

This reinforcing card (3) has on its longitudinal middle area some tabs (31) placed between the two wads of paper (2), that protrude in an oblique direction and towards the upper area of the surface marked out by said reinforcing card (3).

Said tabs (31) have both fold lines (32) coinciding on a longitudinal X-X axis, parallel to the wads of paper (2) and the slots (18) for the extraction of the sheets (21) of cigarette rolling paper.

Said tabs (31) are inclined towards the front and rear walls of the package (13, 11), and the longitudinal orientation of the fold lines (32), determines that said tabs (31) simultaneously apply pressure on the wads of paper (2) towards the lower area and towards the respective front and rear walls (13, 11) of the package, suitably keeping them in place and apart.

These tabs (31) are supported against the upper facing edges of said wads of paper (2), by the tendency itself of the tabs (31) to hinge towards the lower area and recover their flatness, after being folded towards the upper area.

Figure 3:
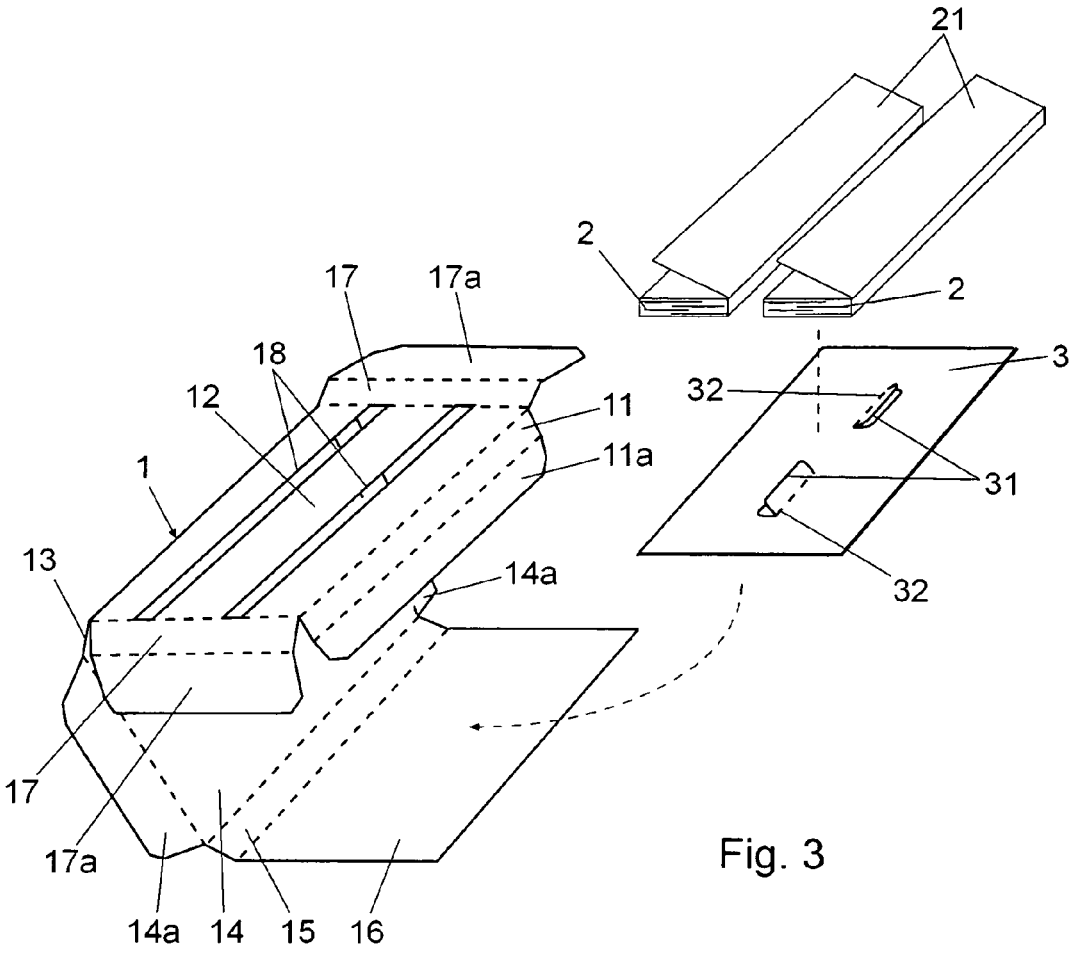
FIG. 3 shows an exploded perspective view of the package.
Figure 4:
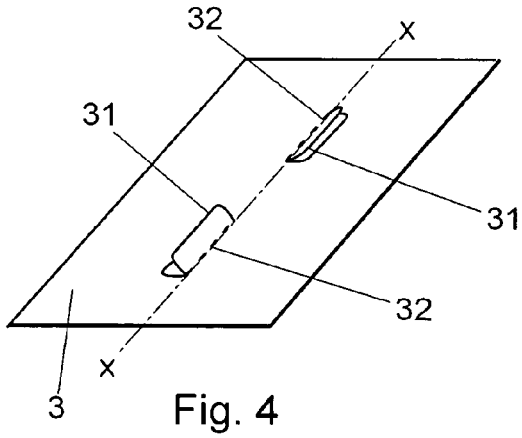
FIG. 4 shows a perspective view of an example of the reinforcing card with the die cut tabs.
Figure 5:
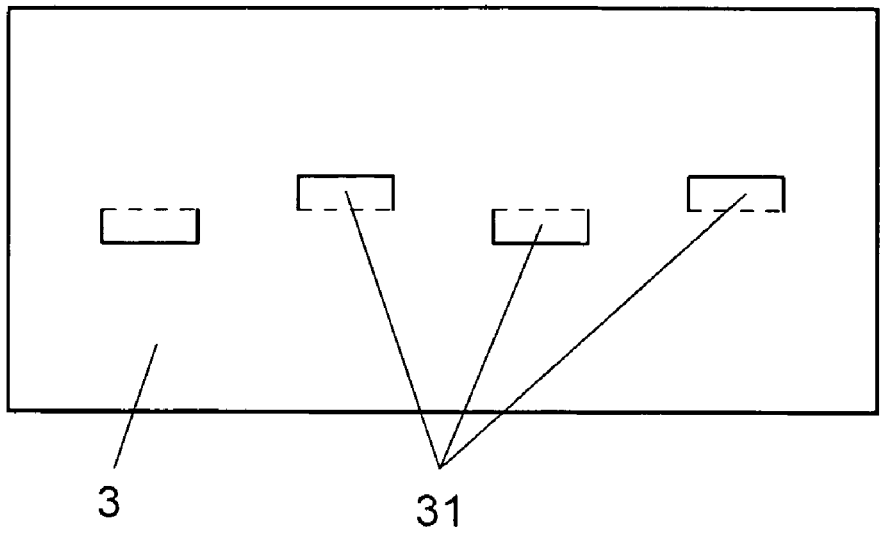
FIG. 5 shows a plan view of the reinforcing card with multiple tabs for the holding of the wads of paper.
Figure 6:
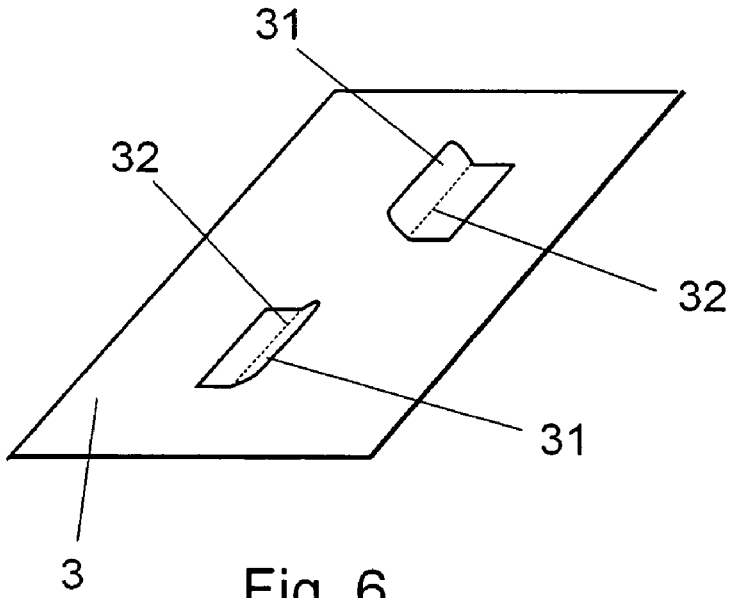
FIG. 6 shows a perspective view of the reinforcing card with the adhesive tabs.

As can be seen in FIGS. 3, 4 and 5 the tabs (31) can be defined by die cutting the reinforcing card itself (3) or being fixed, for example by gluing, either the reinforcing card (3) as shown in FIG. 6, or equally to the inner surface of the lower wall (14) of the card itself or something similar of the package, in which case there will not be a reinforcing card for both wads of paper but that each wad of paper will have its own reinforcing card of a suitable size and without tabs.

The number of tabs (31) can also be variable, having at least one tab (31) for the holding of each wad of paper (2).

Once having sufficiently described the nature of the invention, likewise having given an example of a preferred embodiment, it is placed on record to whom it may concern that the materials, shapes, sizes and other accessorial elements, used can suitably be substituted for others that are technically equivalent and do not deviate from the essentials of the invention or the scope defined by the claims which are included below.

The invention claimed is:

1. A package for cigarette rolling paper comprising:

a. a folded sheet for extracting cigarette rolling papers;

b. said folded sheet forming a rear wall, a lower wall, an upper wall, a front wall and side walls;

c. said upper wall of said folded sheet having substantially longitudinal slots for extracting cigarette rolling papers;

d. cigarette rolling papers being arranged in at least two substantially parallel zigzag stacks in said package;

e. at least two tabs formed in a reinforcing card, creating fold lines from which said tabs extend, each of said tabs defining a plane that extends upwardly and obliquely from a plane defined by said reinforcing card, and toward at least one stack of said cigarette rolling papers;

f. said reinforcing card being supported on the inside of said package; and g. said at least two tabs each having an upper edge on each of said planes that extends toward and exerts pressure on said parallel zigzag stacks of said cigarette rolling papers; whereby said at least two parallel zigzag stacks of said cigarette rolling papers are prevented from moving on said lower wall and whereby said cigarette rolling papers are extracted easily from said slots in said upper wall of said folded sheet.

2. A package for cigarette papers according to claim 1 wherein said at least two tabs are attached to said at least one reinforcing card.

3. A package for cigarette papers according to claim 1 wherein said at least two tabs are formed by die-cutting said at least one reinforcing card to create fold lines from which said at least two tabs extend.

4. A package for cigarette papers according to claim 1 wherein at least one upper edge of said at least two tabs is angled toward said front wall and the upper edge of another of said at least two tabs is angled toward said rear wall.

5. A package for cigarette papers according to claim 1 wherein said rear wall extends to form a lid which extends over said upper wall and over said substantially parallel slots.

6. A package for cigarette papers according to claim 5 wherein said lower wall and said side walls extend to form wings that form a barrier to contain said parallel zigzag stacks of cigarette papers.

7. A package for cigarette rolling paper comprising:

a. a folded sheet for extracting cigarette rolling papers;

b. said folded sheet forming a rear wall, a lower wall, an upper wall, a front wall and side walls;

c. said upper wall of said folded sheet having substantially longitudinal slots for extracting cigarette rolling papers;

d. cigarette rolling papers being arranged in at least two substantially parallel zigzag stacks in said package;

e. at least two tabs die-cut in a reinforcing card, creating fold lines from which said tabs extend, each of said tabs defining a plane that extends upwardly and obliquely from a plane defined by said reinforcing card, and toward at least one stack of said cigarette rolling papers;

f. said reinforcing card being supported on the inside of said package; and g. said at least two tabs each having an upper edge on each of said planes that extends toward and exerts pressure on said parallel zigzag stacks of said cigarette rolling papers; whereby said at least two parallel zigzag stacks of said cigarette rolling papers are prevented from moving on said lower wall and whereby said cigarette rolling papers are extracted easily from said slots in said upper wall of said folded sheet.

* * * * *

UNITED STATES PATENT AND TRADEMARK OFFICE

CERTIFICATE OF CORRECTION

PATENT NO. : 7,611,014 B2
APPLICATION NO. : 11/455237
DATED : November 3, 2009
INVENTOR(S) : Portella Bobé et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 499 days.

Signed and Sealed this

Twelfth Day of October, 2010

David J. Kappos

David J. Kappos
*Director of the United States Patent and Trademark Office*